United States Patent [19]

Nomura et al.

[11] 4,094,139

[45] June 13, 1978

[54] DISPLAY CONTROL CIRCUIT FOR ELECTRONIC TIMEPIECE

[75] Inventors: Yasushi Nomura, Tokorozawa; Yasuhiko Nishikubo, Iruma, both of Japan

[73] Assignee: Citizen Watch Company Limited, Tokyo, Japan

[21] Appl. No.: 722,242

[22] Filed: Sep. 10, 1976

[30] Foreign Application Priority Data

| | | |
|---|---|---|
| Sep. 12, 1975 | Japan | 50-110649 |
| Oct. 21, 1975 | Japan | 50-142541[U] |
| Oct. 28, 1975 | Japan | 50-146070[U] |

[51] Int. Cl.[2] ..... G04B 19/30

[52] U.S. Cl. ..... 58/50 R; 58/23 R

[58] Field of Search ..... 58/4 A, 23 R, 50 R, 58/85.5; 307/247 A, 141, 222, 293

[56] References Cited

U.S. PATENT DOCUMENTS

| | | | |
|---|---|---|---|
| 3,756,013 | 9/1973 | Berget et al. | 58/50 R |
| 3,943,696 | 3/1976 | Portmann et al. | 58/23 R |
| 3,988,597 | 10/1976 | Yamaguchi | 307/247 A |
| 4,028,878 | 6/1977 | Droz et al. | 58/23 R |

*Primary Examiner*—Robert K. Schaefer
*Assistant Examiner*—Vit W. Miska
*Attorney, Agent, or Firm*—Frank J. Jordan

[57] ABSTRACT

A display control circuit for an electronic timepiece for controlling a timer circuit to vary the length of time for which the display of time or calendar information is to be made. In one preferred embodiment, a timer circuit includes a first section of flip-flops for setting a predetermined length of time when a first external switch is operated, and a second section of flip-flops for setting time interval in addition to the predetermined length of time when a second external switch is operated. A control circuit means is coupled to the timer circuit for controlling the same to vary the total length of time to be set by the timer circuit. In another preferred embodiment, the timer circuit is energized with selected one of frequency signals from a frequency converter of the electronic timepiece to set the length of time in dependence on the selected one of the frequency signals. The frequency signals are selected by operating the external switch a predetermined number of times or by continuously operating the external switch for a prescribed time interval.

6 Claims, 17 Drawing Figures

| DEPRESSED TIME INTERVAL FOR SWITCH 102 | OUTPUT OF FF 1 | OUTPUT OF FF2 | OUTPUT OF AND GATES | | | STATE OF AND GATES | | | SIGNAL ON LEAD 122 | EXACT TIME FOR DISPLAY |
|---|---|---|---|---|---|---|---|---|---|---|
| | | | 130 | 132 | 134 | 140 | 142 | 144 | | |
| Below 0.5 sec. | H | L | H | L | L | OPEN | CLOSED | CLOSED | $f_1$(8Hz) | About 1sec. |
| 0.5~1 sec. | | | | | | | | | | 1~2 sec. |
| 1~1.5 sec. | L | H | L | H | L | CLOSED | OPEN | CLOSED | $f_2$(4Hz) | About 3.0 sec. |
| Beyond 1.5 sec. | H | H | L | L | H | CLOSED | CLOSED | OPEN | $f_3$(2Hz) | About 5.5 sec. |

DISPLAY CONTROL CIRCUIT FOR ELECTRONIC TIMEPIECE

This invention relates in general to electronic timepieces and, more particularly, to an electronic timepiece such as a wristwatch incorporating an electro-optical display elements such as light-emitting diodes, liquid crystals, electrochromic elements, etc.

In recent years, considerable effort has been directed toward the development of a wristwatch which requires a minimum power consumption. In many instances, these constructions have utilized a timer circuit by which a desired data is displayed for a predetermined length of time. In conventional battery-powered wristwatches in which the display is in the form of a plurality of light-emitting diodes, for example, time is continuously being kept but is not displayed on the display surface. That is, no time indication is visible through the window and this is the normal condition which prevails in order to conserve battery energy in the watch. When the wearer desires to ascertain the correct time, he dpresses the external switch or demand switch with his finger and the correct time is displayed for a predetermined length of time set by the timer circuit associated with the external switch. In battery-powered wristwatches of the liquid crystal display type incorporating the calendar function, the hours and minutes are normally displayed and the calendar information is displayed for a predetermined length of time only when the external switch is depressed.

A problem is encountered with these conventional battery-powered wristwatches in that it is impossible to manually vary the length of time for which the display is to be made because of inherent construction of the timer circuit. In some cases, the exact time of the display set by the timer circuit is insufficient for the wearer to determine the correct data. It is thus desired that the exact time of the display be manually varied in accordance with the varying surrounding conditions in which the wristwatch is used.

It is, therefore, an object of the present invention to provide an improved electronic timepiece which permits the display of time or calendar information for a sufficient length of time which can be easily chosen by the wearer.

It is another object of the present invention to provide an electronic timepiece incorporating a simple circuit arrangement capable of varying the length of time for which the display of time or calendar information is to be made.

It is a further object of the present invention to provide an electronic timepiece incorporating a timer circuit and a control means adapted to control the timer circuit so as to vary the length of time set by the timer circuit for the display of a desired data.

These and other objects, features and advantages of the present invention will become more apparent from the following description when taken in conjunction with the accompanying drawings, in which.

Figure 1:
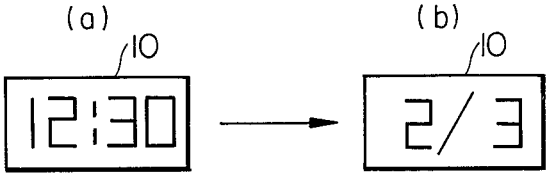
FIGS. 1 and 2 are schematic views showing examples of a liquid crystal display and a light-emitting diode display of electronic timepieces, respectively.

Referring now to FIG. 1, there is schematically shown a display surface 10 of a liquid crystal display device of an electronic wristwatch. As shown in FIG. 1 (*a*), the hours and minutes, i.e., 12:30, are normally displayed on the display surface 10 in a continuous fashion. When, however, an external switch is operated to select calendar function, the months and dates, i.e., $\frac{2}{3}$, are displayed as shown in FIG. 1 (*b*) for a predetermined length of time and, thereafter, the hours and minutes will be automatically again displayed on the display surface 10.

Figure 2:
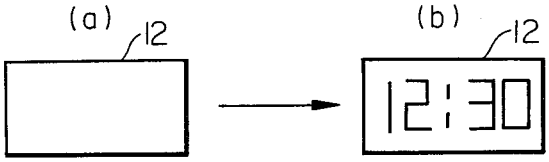

In an electronic wristwatch including a light-emitting diode display device, time is continuously being kept but is not displayed on a display surface 12 in normal operation as shown in FIG. 2 (*a*). When the wearer depresses an external switch, i.e., a demand switch, the correct time is immediately displayed on the display surface 12 as shown in FIG. 2 (*b*) for a predetermined length of time, irrespective of whether or not the demand switch remains depressed. Thereafter, the hours and minutes of the display are extinguished, i.e., they disappear.

In the electronic wristwashes mentioned above, it has been a common practice to provide a timer circuit operable in response to the depression of the external switch to cause the display device to display time or calendar information for the predetermined length of time. In these electronic timepieces, the timer circuit is usually arranged such that a predetermined length of time for which display of desired data is to be made is fixed in advance at a constant value.

Thus, a difficulty is encountered with the prior art timer circuit incorporated in the electronic wristwatches in that it is impossible to vary the length of time preset by the timer circuit in accordance with the wearer's requirement or the surrounding conditions in which the wearer uses the electronic timepiece.

The present invention contemplates the provision of an electronic timepiece incorporating a control circuit means to control the operation of a timer circuit so as to allow the timer circuit to set various lengths of time to give the wearer adequate time to consult the display to sufficiently determine the displayed data.

Figure 3:
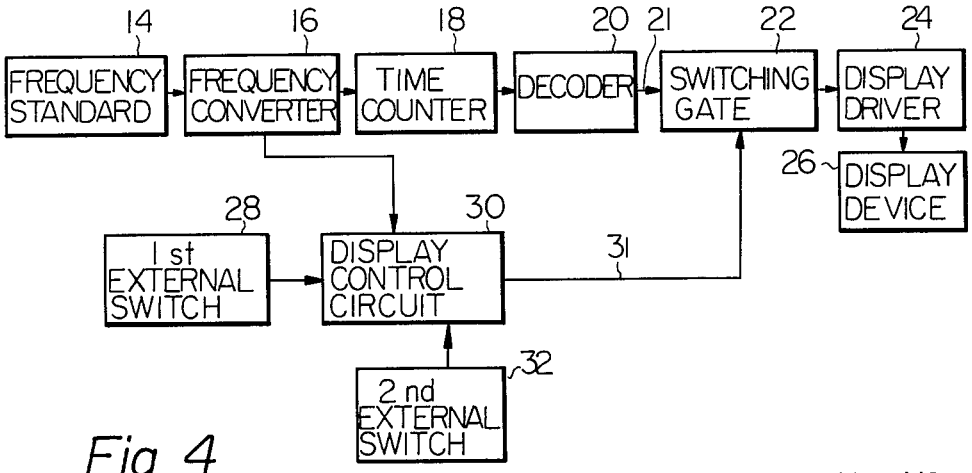
FIG. 3 is a block disgram of an electronic timepiece according to the present invention.

A preferred embodiment of an electronic timepiece to achieve the above concept is illustrated in a simplified block diagram of FIG. 3. As shown, the electronic timepiece comprises a time base or a frequency standard 14, preferably chosen to produce an electrical output signal at a relatively high frequency. This relatively high frequency is supplied to a frequency converter 16 in the form of a divider which divides down the frequency from the frequency standard 14 so that the output from the converter 16 is at a low frequency of, for example, 1 Hz. This low frequency signal is applied to a time counter 18. In the electronic timepiece incorporating a light-emitting diode display device, the time counter 18 may comprise a minutes counter and an hours counter. In an electronic timepiece incorporating a liquid crystal display device, the time counter 18 may also comprise a dates counter and a months counter in addition to the minutes and hours counters. The outputs from the time counter 18 are applied to a decoder 20 which convert the outputs from the time counter 18 into binary coded signals. The binary coded signals are selectively passed through a switching gate 22 to a display driver 24, which drives a display device 26 incorporating an electro-optical display element.

The electronic timepiece also comprises a first external switch 28 which is normally held in its inoperative condition and operative to cause the switching gate 22 to couple the time counter 18 to the display device 26 via the decoder 20 and the display driver 24 to energize the same. A display control circuit 30 is coupled between the first external switch 28 and the switching gate 22 to cause the switching gate to couple the time counter to the display device for a predetermined length of time. A second external switch 32 is also coupled to the display control circuit 30 to control a timer circuit incorporated therein to vary the length of time set by the timer circuit.

Figure 4:
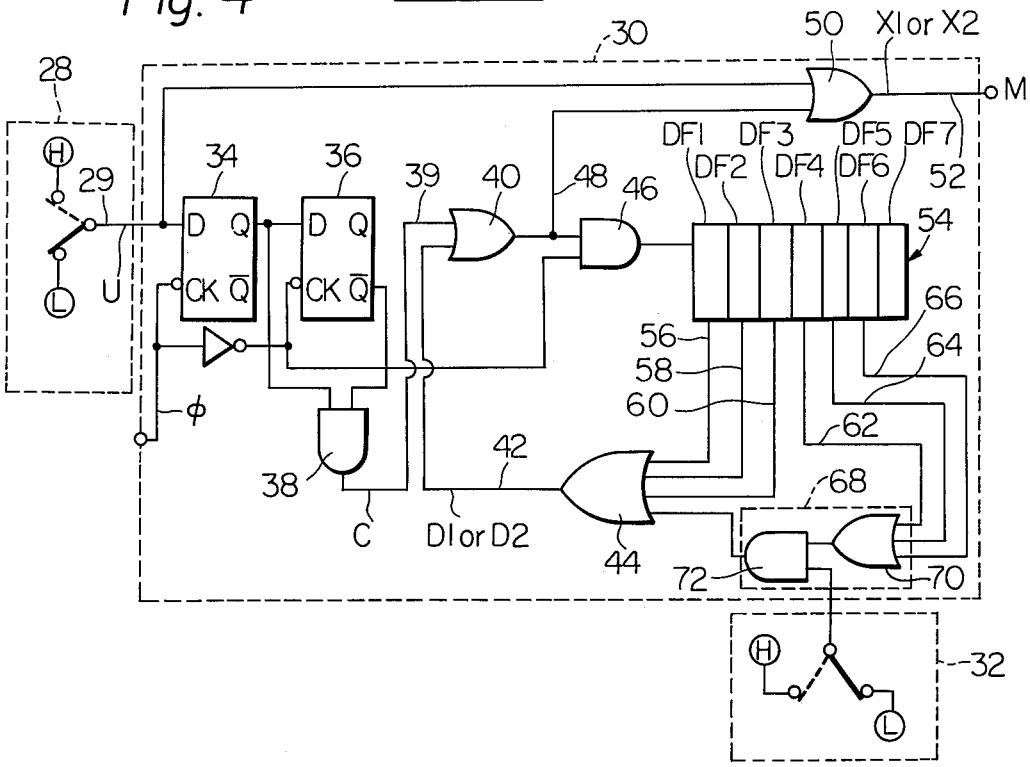
FIG. 4 is a detailed circuitry for the electronic timepiece shown in FIG. 3.

FIG. 4 shows a detail circuitry for the display control circuit 30 shown in FIG. 3. In FIG. 4, the display control device 30 comprises first and second data-type flip-flops 34 and 36. The first data-type flip-flop 34 has the data input terminal coupled to the first external switch 28, which is normally connected to the lower potential side L of a battery (not shown). The inverted clock input terminal of the first data-type flip-flop 34 is coupled to an intermediate stage of the frequency converter 16 (see FIG. 3) to receive a clock signal therefrom. The Q output of the first data-type flip-flop 34 is coupled to the data input terminal of the second data-type flip-flop 36, whose inverted clock input terminal is coupled to receive the inverse of the clock signal $\phi$. The Q output of the first data-type flip-flop 34 and the $\overline{Q}$ output of the second data-type flip-flop 36 are coupled to inputs of an AND gate 38, which produces an output signal C on lead 39 when the first external switch 28 is coupled to the high potential side H of the battery. The output of the AND gate 38 is coupled through lead 39 to one input of an OR gate 40, to the other input of which is coupled to output of an OR gate 44. The output of the OR gate 40 is coupled to one input of an AND gate 46 whose another input is adapted to receive the inverse of the clock signal $\phi$. The output of the OR gate 40 is also coupled through lead 48 to one input of an OR gate 50, to the other input of which is coupled the first external switch 28 through lead 29 to provide outputs $X_1$ or $X_2$ on lead 52 in a manner as will be subsequently described. The output of the AND gate 46 is coupled to a timer circuit 54 composed of a first section of data-type flip-flops DF1, DF2 and DF3 and a second section of data-type flip-flops DF4, DF5, DF6 and DF7. The outputs from the data-type flip-flops DF1, DF2 and DF3 of the first section are directly applied through leads 56, 58 and 60 to first inputs of the OR gate 44, whereas the outputs from the data-type flip-flops DF4, DF5 and DF6 are selectively applied through a control gate means 68 to a second input of the OR gate 44. The control gate means 68 comprises an OR gate 70 having inputs coupled to the leads 62, 64 and 66, and an AND gate 72 having one input coupled to the output of the OR gate 70 and the other input coupled to the second external switch 32 by which the control gate means 68 is controlled.

Figure 5:
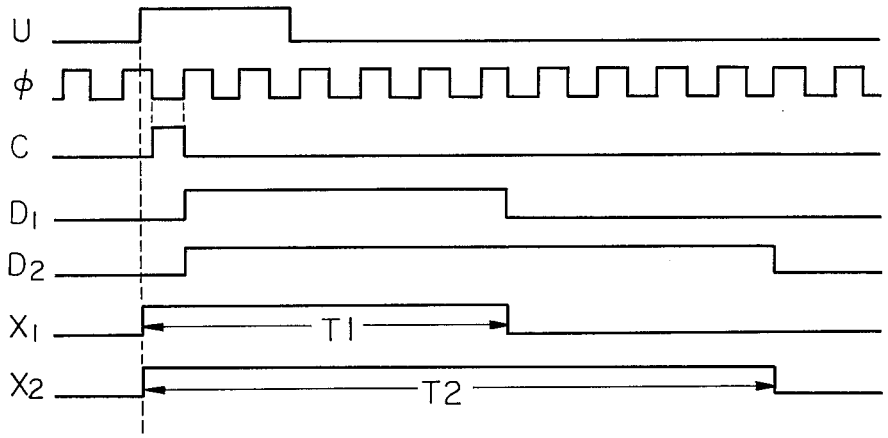
FIG. 5 is a timing chart for illustrating the operation of the circuit shown in FIG. 4.

When, in operation, the first external switch 28 is coupled to the positive potential side H of the battery to produce an output U on lead 29 for a given period of time as shown in FIG. 5, the first data-type flip-flop 34 produces an output signal at the Q output in synchronism with the falling edge of the clock signal $\phi$. This output signal is applied to the data-type flip-flop 36, which consequently produces an output signal at the Q output in synchronism with the rising edge of the clock signal $\phi$. The output signals from the first and second data-type flip-flops 34 and 36 are applied to the AND gate 38, which produces an output signal on lead 39 as shown by the waveform C in FIG. 5. The output signal C is applied through the OR gate 40 to the AND gate 46, which is consequently opened. As a result, the inverse of the clock signal $\phi$ is applied through the AND gate 46 to the data-type flip-flop DF1 of the timer circuit 54. In this instance, the output of the data-type flip-flop DF1 goes to a high level and is applied through the OR gates 44 and 40 to the AND gate 46 which is caused to reamin opened, passing the inverted clock signal $\overline{\phi}$ to the timer circuit 54. The outputs of the remaining data-type flip-flops DF2 and DF3 go to a high level in sequence in response to the inverted clock signal $\overline{\phi}$ gated through the AND gate 46 and are applied to the OR gate 44 which produces an output on lead 42 as shown by the waveform D1 in FIG. 5. The output D1 remains at a high level until all of the outputs of the first section of the timer circuit 54 go to a low level, i.e., for a first predetermined time interval. This output D1 is applied through the OR gate 40 and lead 48 to the one input of the OR gate 50, to the other input of which is also applied the output U from the first external switch 28. Thus, the OR gate 50 produces an enabling signal as shown by the wave form X1 in FIG. 5 for a first predetermined length T1 of time.

If the second external switch 32 is coupled to the positive potential side H of the battery after the first external switch 28 has been operated, the AND gate 72 is opened to pass the outputs from the second section of the timer circuit 54 to the input of the OR gate 44. In this instance, the OR gate 44 produces an output as shown by the waveform D2 in FIG. 5 which remains at a high level for a second predetermined time interval. The output D2 is applied through the OR gate 40 and lead 48 to the one input of the OR gate 50, to the other input of which is also applied the output U from the first external switch 28. Thus, the OR gate 50 produces an enabling signal as shown by the waveform X2 in FIG. 5 which remains at a high level for a second predetermined length T2 of time.

It will thus be understood that the display control circuit 30 selectively produces first and second enabling signals for first and second predetermined lengths of time, respectively, upon operations of the first and second external switches. The enabling signal appearing on lead 52 is supplied to an output terminal M from which it is applied through lead 31 to the switching gate 22 as shown in FIG. 3.

Figure 6:
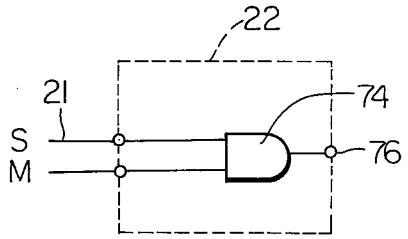
FIG. 6 shows an example of a part of the circuit shown in FIG. 3.

FIG. 6 shows a preferred example of the switching gate 22 shown in FIG. 3 for the electronic timepiece incorporating the light emitting diode display device shown in FIG. 2. The switching gate 22 comprises an AND gate 74 having one input coupled through lead 21 to the decoder 20 to receive the binary coded signal S therefrom for the minutes and hours time and the other input coupled to the output terminal M of the display control circuit. The output of the AND gate 74 is coupled through a terminal 76 to the display driver. In normal operation, the output terminal M remains at a low level and, therefore, the AND gate 74 is inhibited. Thus, the binary coded signal S from the decoder for the minutes and hours of the display is not gated through the AND gate 74 to the terminal 76 and, consequently, the minutes and hours of the display remain extinguished. When the output terminal M goes to a high level, the binary coded signal S is passed to the terminal 76 for a predetermined length of time set by the display control circuit mentioned above.

Figure 7:
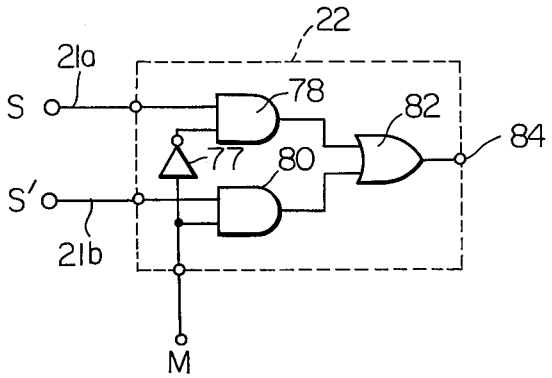
FIG. 7 shows another example of the part shown in FIG. 6.

FIG. 7 shows another preferred example of the switching gate 22 shown in FIG. 3 for the electronic timepiece incorporating the liquid crystal display device shown in FIG. 1. In this preferred example, the switching gate 22 comprises an inverter 77, first and second AND gates 78 and 80, and an OR gate 82. The first AND gates 78 has one input adapted to receive a first binary coded signal S for the minutes and hours of the display and the other input coupled through the inverter 77 to the output terminal M. The second AND gate 80 has one input adapted to receive a second binary coded signal S' for the dates and months of the display and the other input directly coupled to the output terminal M. In normal operation, the output terminal M remains at a low level and, therefore, the first AND gate 78 is opened whereas the second AND gate 80 is inhibited. Consequently, the binary coded signal S is passed through the first AND gate 78 and the OR gate 82 to the output terminal 84 so that the hours and minutes are normally displayed by the display device. When the output terminal M goes to a high level, the first AND gate 78 is inhibited and the second AND gate 80 is opened, gating the binary coded signal S' through the second AND gate 80 and the OR gate 82 to the output terminal 84. In this instance, the dates and months of the calendar information are displayed by the display device for a predetermined time interval set by the display control circuit.

As already mentioned hereinabove, since the enabling signal appearing on the output terminal M goes to a high level for selected lengths of time upon operation of the second external switch 32, it is possible to change the time interval for which the minutes and hours are continuously displayed by the action of the switching gate 22 of FIG. 6 and the time interval for which the dates and months are continously displayed by the action of the switching gate of FIG. 7.

In case of an electronic timepiece incorporating a light-emitting diode display device, the display contrast will be suffered in a relatively light place. In this situation, the exact time of the display is chosen to give the wearer a longer time to sufficiently consult the display to determine the hours and minutes. In an electronic timepiece incorporating a liquid crystal display device, the display contrast will be suffered in the relatively dark place. In this situation, the exact time of the display is chosen to give the wearer a longer time to sufficiently consult the display to determine the dates and months.

In the illustrated embodiment of FIG. 4, the display control circuit has been shown as arranged to vary the length of time set by the timer circuit in two modes by way of example, it should be noted that the display control circuit may be modified to change the length of time set by the timer circuit in more than three modes or to vary the length of time set by the timer circuit in a continuous fashion. It should also be understood that the external switch 32 may be replaced with an external control terminal which is incorporated within a watch case and which is adjusted to cause the display control circuit to produce an enabling signal for a selected length of time for the display of desired data in advance at the factory or the shop before the electronic timepiece is sold.

Figure 8:
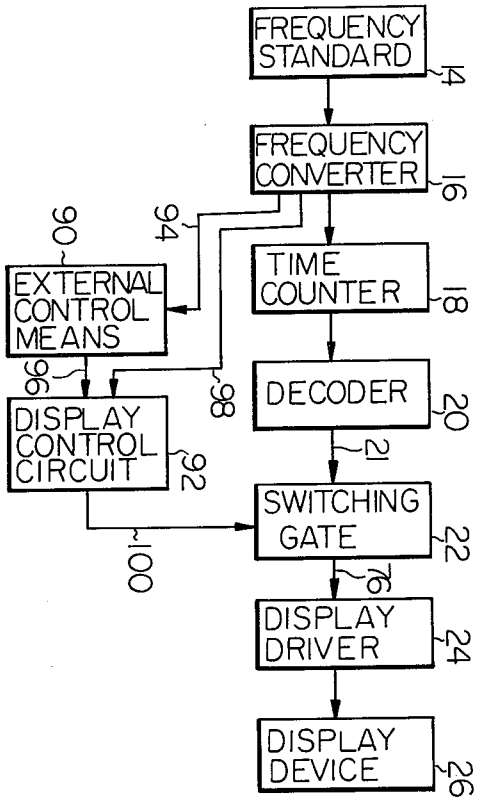
FIG. 8 is a block diagram of another preferred embodiment of the electronic timepiece according to the present invention.

Another preferred embodiment of the electronic timepiece according to the present invention is shown in a simplified block diagram of FIG. 8, with like parts bearing like reference numerals as those used in FIG. 4. This embodiment differs in construction from that of FIG. 3 only in that the length of time set by a display control circuit 92 is varied in dependence on the number of operations of the external control means 90. To this end, the external control means 90 is coupled to an intermediate stage of the frequency converter 16 via lead 94 and to the display control circuit 92 via lead 96. The display control circuit 92 is coupled to an intermediate state of the frequency converter 16 via lead 98 and to the switching gate 22 via lead 100.

Figure 9:
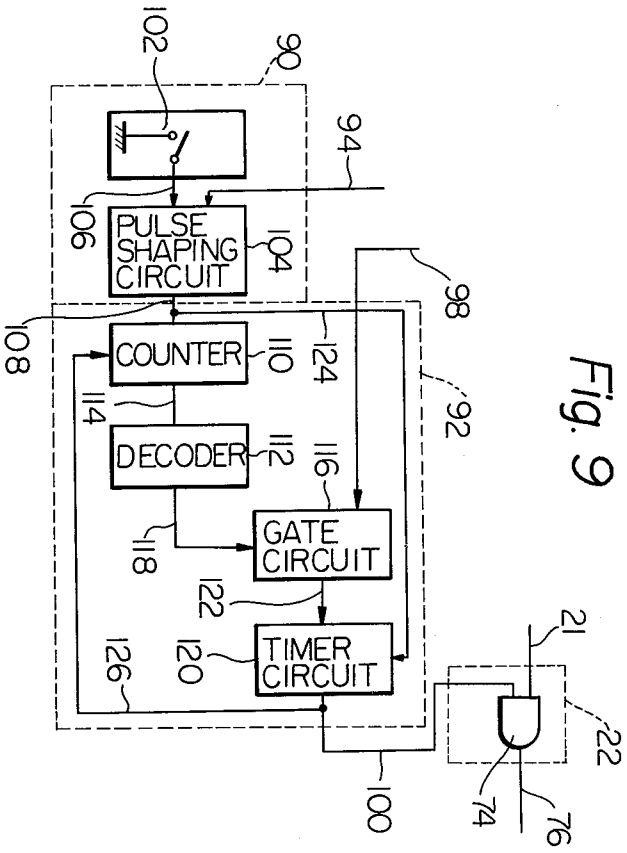
FIG. 9 is a detail block diagram of part of the circuit shown in FIG. 8.

FIG. 9 shows a detail block diagram of the display control circuit 92 shown in FIG. 8. In FIG. 9, the external control means 90 is composed of an external switch 102 which is normally held in its open condition and a pulse shaping circuit 104 coupled to the external switch 102 via lead 106. The pulse shaping circuit 104 receives an output signal generated by the external switch 102 when it is closed and generates an output signal on lead 108 in synchronism with a frequency signal fed from the frequency converter 16 via lead 94. This output signal on lead 108 is supplied to the display control circuit 92. The display control circuit 92 generally comprises a counter 110, a decoder 112 coupled to the counter 110 via lead 114, a gate circuit 116 coupled to the frequency converter 16 and the decoder 112 via leads 98 and 118, respectively, and a timer circuit 120 coupled to the gate circuit 116 via lead 122.

The counter 110 is arranged to count the number of output pulses appearing on lead 108 and generate output signals in response to the number of operations of the external switch 102. These output signals are fed via lead 114 to the decoder 112, which generates output signals in dependence on the output signals from the counter 110 for thereby opening selected one of gates constituting the gate circuit 116. The gate circuit 116 is supplied via lead 98 with frequency signals from the frequency converter 16 at various frequencies. A selected one of various frequency signals is gated through the selected one of the gates opened in response to the particular output signal from the decoder 112 and supplied via lead 122 to the timer circuit 120. The timer circuit 120 is set by the output pulse appearing on lead 124 coupled to lead 108 and an output on lead 100 goes to a high level. Subsequently, the output on lead 100 attains a low level after a certain time interval adversely proportional to the frequency of the selected one of the frequency signals applied to the timer circuit 120. This low output at low level is in turn supplied to the counter 110, which is consequently reset. As a result, all of the gates of the gate circuit 116 are inhibited and none of the frequency signals is gated therethrough to the timer circuit 120 so that the output from the timer circuit 120 on lead 100 remains at a low level.

During the time interval in which the output on lead 100 remains at a high level, the AND gate 74 of the switching gate 22 is opened to pass the binary coded signal from the decoder 20 to the driver circuit 24 via lead 76. Thus, the driver circuit 24 causes the display device to display time. Since the timer circuit 120 is adapted to receive selected one of various frequency signals in dependence on the number of operations of the external control means, it is possible to vary the length of time set by the timer circuit 120 such that the wearer can sufficiently consult the display to determine the time.

Figure 10:
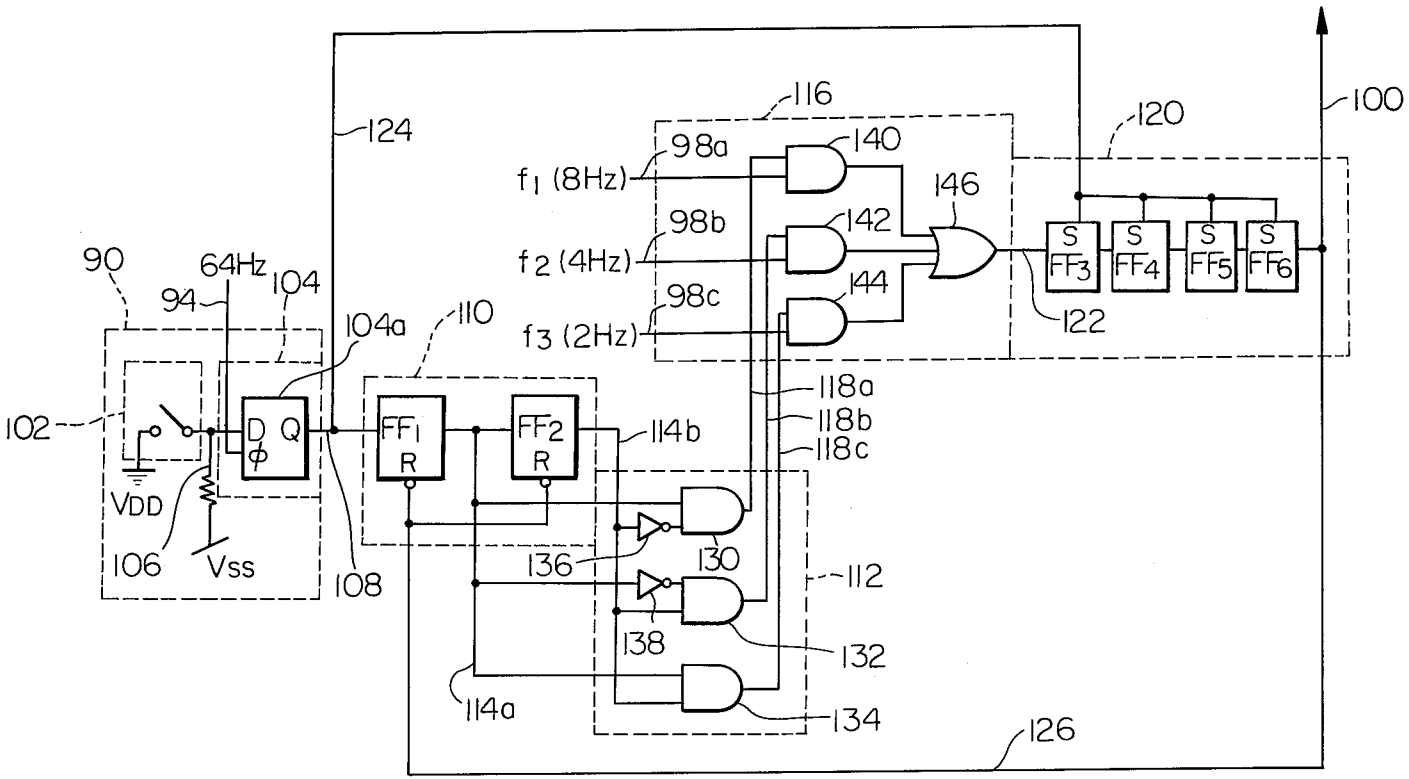
FIG. 10 is a detail circuitry for the circuit shown in FIG. 9.

FIG. 10 shows a detail circuitry for the display control circuit shown in FIG. 9. In FIG. 10, the pulse shaping circuit 104 is shown as comprising a data-type flip-flop **104*a* having its data input terminal coupled via lead 106 to the external switch 102 and its clock input terminal coupled to lead 94 to receive a signal at a frequency of 64 Hz. The Q output of the data-type flip-flop 104*a* is coupled to the counter 110. The counter 110 comprises flip-flops FF1 and FF2. The input of the flip-flop FF1 is coupled to the lead 108 and the output is coupled to the flip-flop FF2 and the decoder 112 via lead 114*a*. The output of the flip-flop FF2 is coupled via lead 114*b* to the decoder 112. The decoder 112 comprises AND gates 130, 132 and 134. The AND gate 130 has its one input coupled via lead 114*a* to the output of the flip-flop FF1 and the other input coupled through an inverter 136 and lead 114*b* to the output of the flip-flop FF2. The AND gate 132 has its one input coupled through an inverter 138 and lead 114*a* to the output of the flip-flop FF1 and the other input coupled through lead 114*b* to the output of the flip-flop FF2. The AND gate 134 has its one input coupled via lead 114*a* to the output of the flip-flop FF1 and the other input coupled via lead 114*b* to the output of the flip-flop FF2. The outputs of the AND gates 130, 132 and 134 appearing on leads 118*a*, 118*b* and 118*c* are coupled to inputs of AND gates 140, 142 and 144, respectively, of the gate circuit 116. The other inputs of the AND gates 140, 142 and 144 are coupled through leads 98*a*, 98*b* and 98*c* to the frequency converter 16 (see FIG. 8) to receive frequency signals f1, f2 and f3 at the frequency of 8, 4 and 2 Hz, respectively. The outputs of the AND gates 140, 142 and 144 are coupled to inputs of an OR gate 146, the output of which is coupled via lead 122 to the timer circuit 120. The timer circuit comprises flip-flops FF3, FF4, FF5 and FF6, whose set terminals are coupled via lead 124 to the output of the data-type flip-flop 104*a*. The output of the timer circuit 120 is coupled to lead 100 connected to the switching gate 22 and lead 126 coupled to the reset terminals of the flip-flops FF1 and FF2 of the counter 110**.

Figure 11:
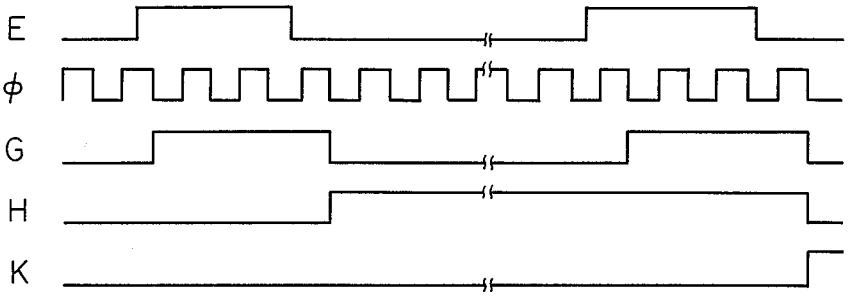
FIG. 11 is a timing chart for illustrating the operation of the circuit shown in FIG. 10.

When, in operation, the external switch 102 is depressed several times to generate output signals as shown by the waveform E in FIG. 11, the data-type flip-flop **104*a* generates output pulses as shown by G in FIG. 11 in synchronism with the clock signal $\phi$ at the frequency of 64 Hz. The output pulses G are applied to the set terminals of the timer circuit 120 via lead 124, thereby setting the flip-flops FF3, FF4, FF5 and FF6 whereby the output of each flip-flop goes to a high level. At the same time, the output pulses G are applied to the input of the flip-flop FF1. Thus, the flip-flop FF1 generates an output signal as shown by the waveform H in FIG. 11. The output signal H is applied to the input of the flip-flop FF2, which consequently generates an output signal as shown by the waveform K in FIG. 11. When the external switch 102 is depressed one time, the output of the flip-flop FF1 goes to a high level while the output of the flip-flop FF2 remains at a low level. Consequently, the output of the AND gate 130 of the decoder 112 goes to a high level, opening the AND gate 140 of the gate circuit 116. In this condition, the frequency signal f1 at the frequency of 8 Hz is applied through the OR gate 146 to the timer circuit 120 so that the outputs of the flip-flops FF3, FF4, FF5 and FF6 will change in state in sequence. After a prescribed time interval, the output of the flip-flop FF6 goes to a low level and the flip-flops FF1 and FF2 of the counter 110 are reset. In this instance, the outputs of the flip-flops FF1 and FF2 go to a low level, inhibiting the AND gates 130, 132 and 134 so that the outputs of these gates go to a low level. Consequently, all of the AND gates 140, 142 and 144 of the gate circuit 116** are inhibited and, therefore, none of the frequency signals *f*1, *f*2 and *f*3 is applied to the timer circuit 120.

When, now, the external switch 102 is depressed a second time before the output of the flip-flop FF6 of the timer circuit 120 goes to a low level, all of the flip-flops FF3, FF4, FF5 and FF6 of the timer circuit 120 are set. At the same time, the outputs of the flip-flops FF1 and FF2 of the counter 110 attain low and high levels, respectively, as shown by the waveforms H and K in FIG. 11. In this condition, the output of the AND gate 130 of the decoder 112 goes to a low level, whereas the output of the AND gate 132 goes to a high level. The output appearing on lead **118*b* is applied to the AND gate 142 of the gate circuit 116** so that the frequency signal *f*2 at the frequency of 4 Hz is applied through the OR gate 146 to the timer circuit 120. Consequently, the output of the timer circuit 120 is maintained at a high level for a predetermined time interval determined by the frequency of the frequency signal *f*2 and, thereafter, the output of the timer circuit 120 goes to a low level, resetting the flip-flops FF1 and FF2 of the counter 110.

When the external switch 102 is depressed a third time before the output of the flip-flop FF6 goes to a low level after the timer circuit 120 has been supplied with the frequency signal *f*2, the timer circuit 120 is supplied with the frequency signal *f*3 through the gate circuit 116. In this condition, the output of the timer circuit 120 remains at a high level for a time interval adversely proportional to the frequency of the frequency signal *f*3.

It will thus be understood that the length of time set by the timer circuit 120 can be varied by varying the number of operations of the external control means 90 whereby the wearer can easily consult the display of desired data on the display surface of the electronic timepiece.

Figure 12:
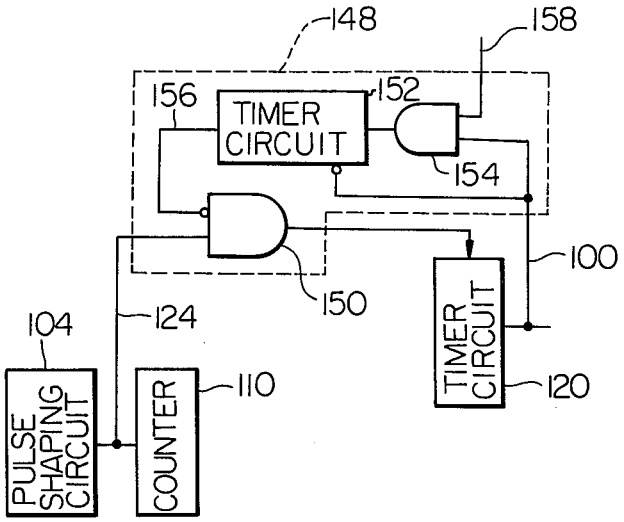
FIG. 12 is a modification of part of the circuit shown in FIG. 10.

FIG. 12 shows a modified form of the electronic timepiece shown in FIG. 10. In this modification, the electronic timepiece further comprises a control circuit 148 including AND gates 150 and 154 and a timer circuit 152. The AND gate 150 has one input coupled via 124 to the output of the pulse shaping circuit 104 and the other inverted input coupled via lead 156 to the output of the timer circuit 152. The output of the AND gate 150 is coupled to the set terminal of the timer circuit 120. The AND gate 154 has one input coupled via lead 158 to an intermediate stage of the frequency converter (not shown) to receive a frequency signal therefrom and the other input coupled to the output of the timer circuit 120. The output of the AND gate 154 is coupled to an input of the timer circuit 152, whose inverted reset terminal is coupled to the output of the timer circuit 120.

When the output of the timer circuit 120 remains at a high level, the AND gate 154 is opened so that the frequency signal appearing on lead 158 is applied to the input of the timer circuit 152. The timer circuit 152 generates an output signal on lead 156 after a prescribed time interval upon receiving the frequency signal. During this time interval, since the output on lead 156 remains at a low level, the AND gate 150 is opened and, therefore, the output pulses generated by the pulse shaping circuit 104 is applied to the timer circuit 120 via the AND gate 150. However, when the output of the timer circuit 152 goes to a high level, the AND gate 150 is inhibited so that any output pulse generated by the pulse shaping circuit 104 can not be applied to the timer circuit 120. Thus, the length of time set by the timer circuit 120 can be varied only when the external switch is depressed a predetermined number of times within the prescribed time interval set by the timer circuit 152.

Figure 13:
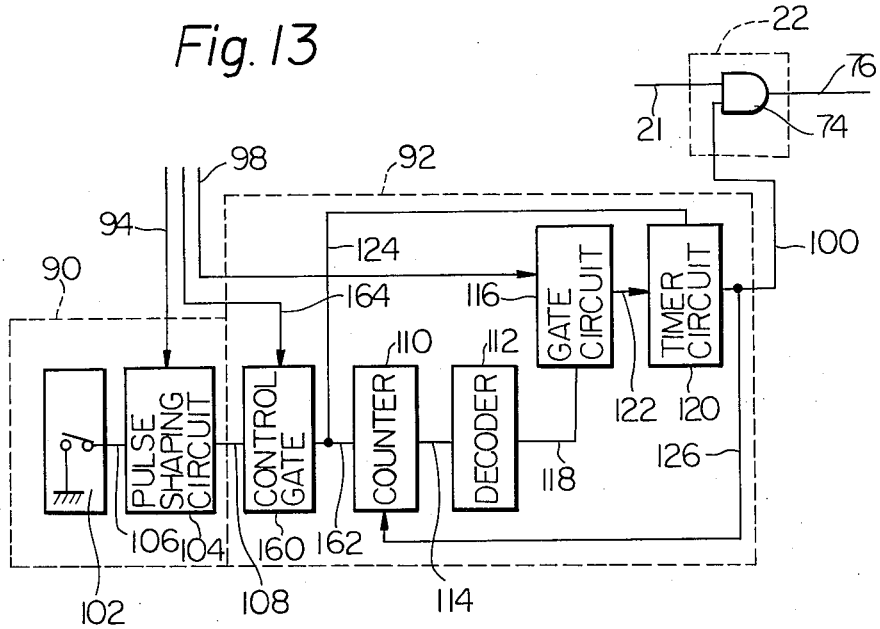
FIG. 13 is a block diagram showing a modification of the electronic timepiece shown in FIG. 9.
Figure 14:
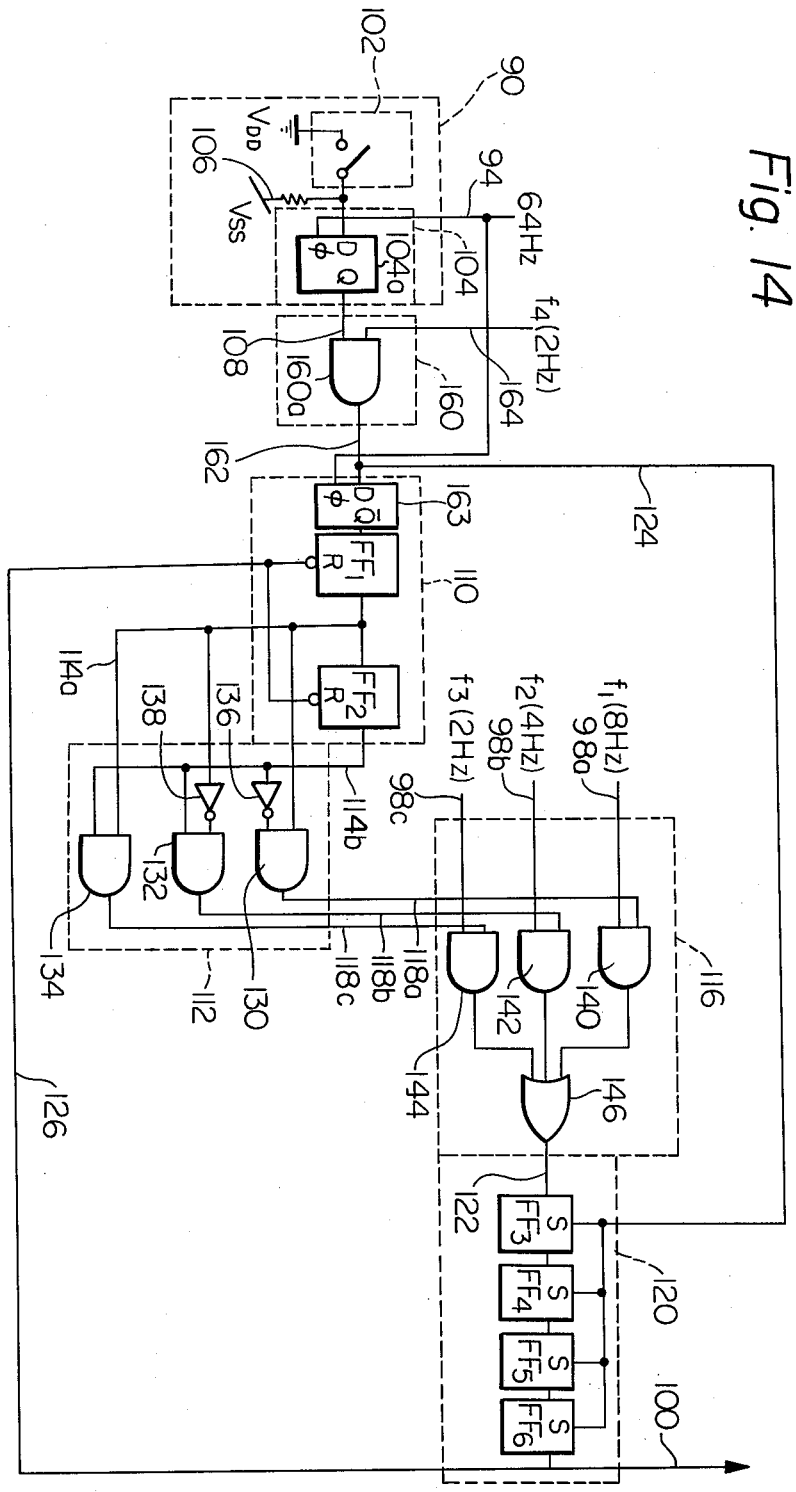
FIG. 14 is a detail circuitry for the electronic timepiece shown in FIG. 13.

FIG. 13 shows a modified form of the electronic timepiece shown in FIG. 9 with like parts bearing like reference numerals as those used in FIGS. 9 and 10. In this modification, a control gate 160 is coupled between the pulse shaping circuit 104 and the counter 110 and adapted to receive a frequency signal from the frequency converter (not shown) via lead 164. As shown in FIG. 14, the control gate 160 comprises an AND gate **160*a* having one input coupled via lead 108 to the Q output of the data-type flip-flop 104*a* and the other input coupled via lead 164 to the frequency converter. The output of the AND gate 160*a* is coupled via lead 162 to a delay circuit composed of a data-type flip-flop 163 which serves to delay the output of the AND gate 160*a*** in phase.

Figures 15, 16:
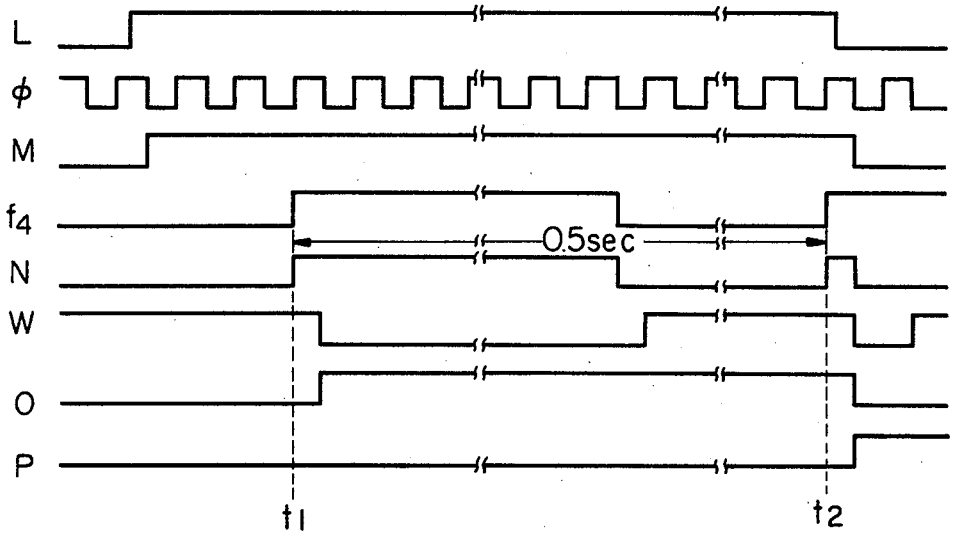
FIG. 15 is a timing chart for illustrating the operation of the circuit shown in FIG. 14.
FIG. 16 shows a table illustrating the operation of the circuit shown in FIG. 14.

With the arrangement mentioned above, when the external switch 102 is closed as shown by the waveform L in FIG. 15, the pulse shaping circuit 104 generates an output pulse as shown by the waveform M in FIG. 15 in synchronism with the falling edge of the clock signal $\phi$. The output pulse appearing on lead 108 is applied to the AND gate **160*a*, which consequently generates an output as shown by the waveform N in FIG. 15. The output N is passed to the data input terminal of the data-type flip-flop 163, which generates at its $\overline{Q}$ output an output signal as shown by the waveform W in FIG. 15. This output W is applied to the flip-flop FF1 of the counter 110. In this instance, the flip-flop FF1 generates an output signal as shown by the waveform O in FIG. 15. The output O is then applied to the flip-flop FF2, which consequently generates an output signal as shown by the waveform P in FIG. 15**.

If the external switch 102 is depressed for a time interval shorter than 0.5 seconds, the output of the flip-flop FF1 goes to a high level while the output of the flip-flop FF2 remains at a low level. In this instance, the AND gates 130 and 140 are opened and, accordingly, the frequency signal *f*1 at the frequency of 8 Hz is applied to the timer circuit 120. As a result, the output appearing on lead 100 is at a high level for about one second as indicated in the Table shown in FIG. 16. When the external switch 102 is depressed for a time interval from 0.5 to 1 second, the timer circuit 120 is initially set at the time instant *t*1 and subsequently set at the time instant *t*2 by the output signal W as seen in FIG. 15. Thus, the output appearing on lead 100 is at a high level for a time interval from 1 to 2 seconds. If the external switch 102 is depressed for a time interval from 1 to 1.5 seconds, the output of the flip-flop FF1 goes to a low level while the output of the flip-flop FF2 goes to a high level. In this instance, the AND gates 132 and 142 are opened and the timer circuit 120 is energized with the frequency signal *f*2 at the frequency of 4 Hz. Thus, the output appearing on lead 100 is at a high level for about 3 seconds. If the external switch 102 is depressed for a time interval beyond 1.5 seconds, the AND gates 134 and 144 are opened and the timer circuit 120 is energized with the frequency signal *f*3 at the frequency of 2 Hz. Thus, the output appearing on lead 100 is at a high level for about 5.5 seconds.

Figure 17:
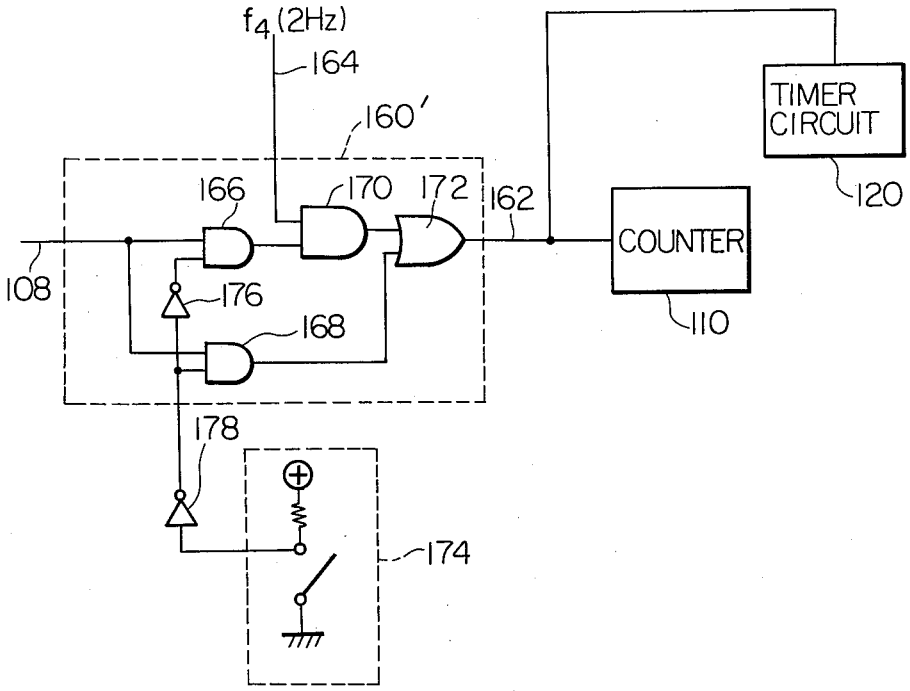
FIG. 17 is a modification of part of the circuit shown in FIG. 14.

A modified form of the electronic timepiece shown in FIGS. 13 and 14 is shown in FIG. 17 in which the external switch 102, the pulse shaping circuit 104, the decoder 112 and the gate circuit 116 are omitted for the sake of simplicity of illustration. In this modification, the control gate 160' comprises AND gates 166, 168 and 170, and an OR gate 172. The AND gate 166 has one input coupled via lead 108 to the pulse shaping circuit (not shown) and the other input coupled to an additional external switch 174 via inverters 176 and 178. The AND gate 168 has one input coupled to the lead 108 and the other input coupled to the additional switch 174 via the inverter 178. The output of the AND gate 166 is coupled to one input of the AND gate 170, the other input of which is coupled to lead 164 to receive the frequency signal *f*4. The output of the AND gate 170 is coupled to one input of the OR gate 172, to the other input of which is coupled the output of the AND gate 168. The output of the OR gate 172 is coupled via lead 162 to the counter circuit 110 and the timer circuit 120.

In normal operation, the additional switch 174 is open, the AND gate 166 is opened and the AND gate 168 is inhibited. In this situation, the control gate 160' will operate in the same manner as that of FIG. 14. If, however, the additional switch 174 is closed, the AND gate 166 is closed and the AND gate 168 is opened so that the output pulses generated by the pulse shaping circuit is applied through the AND gate 168 and the OR gate 172 to the counter 110. In this manner, the length of time set by the timer circuit 120 can be varied in dependence on the number of operations of the external switch 102.

It will now be appreciated from the foregoing description that in accordance with the present invention a desired data can be displayed on the display surface of the electronic timepiece for a time interval proper for the wearer to sufficiently consult the display of the desired data. It will also be noted that the length of time for which the display of desired data is to be made can be easily varied by operating an external switch or switches.

While the present invention has been shown and described with reference to particular embodiments by way of example, it should be noted that various other changes or modifications may be made without departing from the scope of the present invention.

What is claimed is:

1. In an electronic timepiece having a frequency standard, a frequency converter connected to the frequency standard, a time counter providing a time information signal in response to a low frequency signal from the frequency converter, a decoder providing decoded outputs in response to the time information signal, an electro-optical display device responsive to the decoded outputs to provide a display of time information, and a switching gate coupled between the decoder and the electro-optical display device and normally assuming a first state to inhibit the supply of said decoded outputs to said electro-optical display device and operative to assume a second state to allow the supply of said decoded outputs of said electro-optical display device to cause said display device to display said time information, the improvement comprising:

a first external control switch to provide an output signal when actuated;

a second external control switch to provide a control signal when actuated; and a display control circuit responsive to said output signal to render said switching gate to assume its second state for thereby causing said electro-optical display device to display said time information, said display control circuit including a timer circuit composed of a first section of flip-flops for setting a predetermined length of time in response to said output signal generated upon actuation of said first external control switch and a second section of flip-flops coupled to said first section of flip-flops, first gate means having first inputs coupled to outputs of said flip-flops of said first section and a second input coupled to outputs of the flip-flops of said second section, and second gate means coupled between the outputs of the flip-flops of said second section and said second input of said first gate means, said second gate means responsive to said control signal for passing the outputs of the flip-flops of said second section to the second input of said first gate means which consequently produces an output for a time interval in addition to said predetermined length of time.

2. In an electronic timepiece having an electro-optical display device, a time counter coupled to the display device for causing the display device to display data of the time counter, an external switch and a timer circuit coupled to the external switch for coupling the time counter to the display device for a predetermined length of time upon operation of the external switch to energize the display device, the improvement comprising:

an additional external switch operable to provide a control signal when operated; and control circuit means for controlling the timer circuit in response to said control signal to vary the predetermined length of time set by the timer circuit;

said timer circuit comprising a first section of flip-flops for setting the predetermined length of time in response to an output signal generated upon operation of the external switch and a second section of flip-flops coupled to said first section of flip-flops;

said control circuit means comprising first gate means having first inputs coupled to outputs of the flip-flops of said first section and a second input coupled to outputs of the flip-flops of said second section, and second gate means coupled between the outputs of the flip-flops of said second section and said second input, said second gate means being normally inhibited whereby said first gate means normally produces an output for the predetermined length of time in response to the outputs of the flip-flops of said first section, and said second gate means being operative to pass the outputs of the flip-flops of said second section to said second input in response to said control signal whereby said first gate means produces said output for a time interval in addition to the predetermined length of time in response to the outputs of said first and second sections.

3. In an electronic timepiece having a frequency standard, a frequency converter connected to the frequency standard and having a plurality of intermediate stages to provide a plurality of low frequency signals at frequencies different from each other, a time counter providing a time information signal in response to a low frequency signal from the frequency converter, a decoder providing decoded outputs in response to the time information signal, an electro-optical display device responsive to the decoded outputs to provide a display of time information, and a switching gate coupled between the decoder and the electro-optical display device and normally assuming a first state to inhibit the supply of said decoded outputs to said electro-optical display device and operative to assume a second state to allow the supply of said decoded outputs to said electro-optical display device, the improvement comprising:

external control means to provide output signals the number of which depends on the number of actuation of said external control means; and a display control circuit responsive to said output signals to render said switching gate to assume its second state for thereby causing said electro-optical display device to display said time information, said display control circuit including a timer circuit composed of a plurality of flip-flops for setting a plurality of predetermined lengths of time and connected at its output to said switching gate, said plurality of flip-flops having set terminals connected to an output of said external control means, a counter connected to said external control means to count the number of said output signals to provide outputs in dependence thereon, a decoder circuit connected to said counter to provide a plurality of decoded signals in dependence on the outputs of said counter, and a gate circuit composed of a plurality of first gate means having first inputs coupled to said intermediate stages to receive said plurality of low frequency signals, respectively, and second inputs controlled by said plurality of decoded signals, respectively, and second gate means having inputs coupled to outputs of said first gate means and an output coupled to an input of said timer circuit, said plurality of low frequency signals being selectively applied through said gate circuit to the input of said timer in dependence of said decoded signals representative of the number of actuation of said external control means, whereby said timer circuit provides an output for selected one of said plurality of predetermined lengths of time.

4. The improvement according to claim 3, in which said counter comprises first and second flip-flops.

5. In an electronic timepiece having a frequency standard, a frequency converter connected to the frequency standard, and having a plurality of intermediate stages to provide a plurality of low frequency signals at frequencies different from each other, a time counter providing a time information signal in response to a low frequency signal from the frequency converter, a decoder providing decoded outputs in response to the time information signal, an electro-optical display device responsive to the decoded outputs to provide a display of time information, and a switching gate coupled between the decoder and the electro-optical display device and normally assuming a first state to inhibit the supply of said decoded outputs to said electro-optical display device and operative to assume a second state to allow the supply of said decoded outputs of said electro-optical display device, the improvement comprising:

an external control switch;

circuit means for generating output signals in response to one of said plurality of low frequency signals during a time interval in which said external control switch is actuated;

a display circuit responsive to said output signals to render said switching gate to assume its second state for thereby causing said electro-optical display device to display said time information, said display control circuit including a timer circuit composed of a plurality of flip-flops for setting a plurality of predetermined lengths of time and connected at its output to said switching gate, said plurality of flip-flops having set terminals connected to an output of said circuit means, a counter connected to said external control means to count the number of said output signals to provide outputs in dependence thereon, a decoder circuit connected to said counter to provide a plurality of decoded signals in dependence on the outputs of said counter, and a gate circuit composed of a plurality of first gate means having first inputs coupled to said intermediate stages to receive said plurality of low frequency signals, respectively, and second inputs controlled by said plurality of decoded signals, respectively, and second gate means having inputs coupled to outputs of said first gate means and an output coupled to an input of said timer circuit, said plurality of low frequency signals being selectively applied through said gate circuit to the input of said timer in dependence on said decoded signals representative of the number of said output signal, whereby said timer circuit provides an output for selected one of said plurality of predetermined lengths of time in dependence on the time interval in which said external control switch is actuated.

6. In an electronic timepiece having an electro-optical display device, a frequency standard, a frequency converter to divide an output frequency of the frequency standard to lower frequency signals, a time counter coupled to the frequency converter and the display device for causing the display device to display data of the time counter, an external switch and a timer circuit coupled to the external switch for coupling the time counter to the display device for a predetermined length of time upon operation of the external switch to energize the display device, the improvement comprising:

first means composed of a counter including first and second flip-flops for generating output signals when the external switch is operated;

second means coupled to intermediate stages of the frequency converter to selectively pass selected one of the frequency signals to the timer circuit in response to selected one of said output signals whereby the timer circuit produces an output for a time interval in dependence on the frequency of said selected one of the frequency signals;

a control gate coupled between the external switch and said counter and operative to pass the frequency signal from the frequency converter to said counter when the external switch is operated, whereby said counter generates said output signals in dependence on the frequency of said frequency signal; and an additional external switch coupled to said control gate for directly coupling the external switch to said counter while inhibiting the supply of the frequency signal to said counter when said additional external switch is operated.

* * * * *